US006752207B2

(12) United States Patent
Danos et al.

(10) Patent No.: US 6,752,207 B2
(45) Date of Patent: Jun. 22, 2004

(54) APPARATUS AND METHOD FOR ALTERNATE PATH SYSTEM

(75) Inventors: Jake A. Danos, Stafford, TX (US); Gary D. Hurst, Lake Jackson, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/923,980

(22) Filed: Aug. 7, 2001

(65) Prior Publication Data

US 2003/0029613 A1 Feb. 13, 2003

(51) Int. Cl.[7] ..... E21B 43/08; E21B 17/18

(52) U.S. Cl. ..... 166/278; 166/227; 166/51; 166/242.6

(58) Field of Search ..... 166/51, 278, 242.1, 166/242.3, 242.6, 227, 205

(56) References Cited

U.S. PATENT DOCUMENTS

| | | | | |
|---|---|---|---|---|
| 3,556,219 A | * | 1/1971 | Meldau | 166/278 |
| 4,215,727 A | | 8/1980 | Ter Wijlen | |
| 4,510,996 A | | 4/1985 | Hardin | |
| 4,836,305 A | | 6/1989 | Curlett | |
| 4,945,991 A | | 8/1990 | Jones | 166/278 |
| 5,082,052 A | | 1/1992 | Jones et al. | 166/51 |
| 5,113,935 A | | 5/1992 | Jones et al. | 166/51 |
| 5,161,613 A | | 11/1992 | Jones | 166/242 |
| 5,161,618 A | | 11/1992 | Jones et al. | 166/308 |
| 5,333,688 A | | 8/1994 | Jones et al. | 166/278 |
| 5,341,880 A | | 8/1994 | Thorstensen et al. | |
| 5,390,966 A | | 2/1995 | Cox et al. | 285/137.1 |
| 5,417,284 A | | 5/1995 | Jones | 166/280 |
| 5,419,394 A | * | 5/1995 | Jones | 166/51 |
| 5,435,391 A | | 7/1995 | Jones | 166/308 |
| 5,515,915 A | | 5/1996 | Jones et al. | 166/51 |
| 5,524,937 A | | 6/1996 | Sides, III et al. | |
| 5,842,516 A | | 12/1998 | Jones | 166/56 |
| 5,848,645 A | | 12/1998 | Jones | 166/280 |
| 5,868,200 A | | 2/1999 | Bryant et al. | 166/51 |
| 5,890,533 A | | 4/1999 | Jones | 166/51 |
| 6,220,345 B1 | | 4/2001 | Jones et al. | 166/51 |
| 6,230,803 B1 | | 5/2001 | Morton et al. | |
| 6,409,219 B1 | * | 6/2002 | Broome et al. | 285/3 |
| 2002/0079099 A1 | * | 6/2002 | Hurst et al. | 166/278 |

FOREIGN PATENT DOCUMENTS

| | | | |
|---|---|---|---|
| WO | WO 01/11182 A1 | 2/2001 | E21B/17/042 |
| WO | WO 01/044619 | 6/2001 | |

* cited by examiner

*Primary Examiner*—David Bagnell
*Assistant Examiner*—Thomas S Bomar
(74) *Attorney, Agent, or Firm*—Williams, Morgan & Amerson P.C; Jeffrey Griffin; Brigitte Jeffery Echols

(57) ABSTRACT

This invention includes an apparatus and method for completing a subterranean zone penetrated by a wellbore. One embodiment of the invention is an apparatus for connecting a first sand screen assembly and a second sand screen assembly. The apparatus comprises a tubular housing having an eccentric longitudinal bore therethrough, providing a first fluid communication path through the apparatus, the longitudinal bore defining a housing wall. A longitudinal passageway is disposed within the housing wall, providing a second fluid communication path through the apparatus. The first fluid communication path is capable of communicating fluid flow from a sand screen in the first sand screen assembly to a sand screen in the second sand screen assembly. The second fluid communication path is capable of communicating fluid flow from an alternate path element in the first sand screen assembly an alternate path element in the second sand screen assembly.

24 Claims, 8 Drawing Sheets

APPARATUS AND METHOD FOR ALTERNATE PATH SYSTEM

BACKGROUND OF THE INVENTION

1. Field of the Invention

This invention relates generally to tools used to complete subterranean wells and more particularly relates to apparatus and methods for use in performing gravel pack operations.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well.

One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is mixed with a carrier fluid and is pumped in a slurry down the tubing and through the cross-over, thereby flowing into the annulus between the screen and the wellbore. The carrier fluid in the slurry leaks off into the formation and/or through the screen. The screen is designed to prevent the gravel in the slurry from flowing through it and entering the production tubing. As a result, the gravel is deposited in the annulus around the screen where it becomes tightly packed, forming a "gravel pack." It is important to size the gravel for proper containment of the formation sand, and the screen must be designed in a manner to prevent the flow of the gravel through the screen.

A problem that is frequently encountered in a gravel pack completion, especially in long or highly deviated sections, is the formation of gravel bridges in the annulus between the wellbore and the tubing string. Non-uniform gravel packing of the annulus between the screen and the wellbore often occurs as a result of the premature loss of carrier fluid from the slurry. The fluid can be lost into high permeability zones within the formation, leading to the creation of gravel bridges in the annulus before all the gravel has been placed. These gravel bridges can further restrict the flow of slurry through the annulus, which can result in voids within the gravel pack. Once the well is placed on production, the flow of produced fluids will tend to be concentrated through any voids in the gravel pack, which can result in the migration of fines and sand into the produced fluids and lead to the problems discussed above. Over time the gravel that is deposited within the annulus may have a tendency to settle and fill any void areas, thereby loosening the gravel pack that is located higher up in the wellbore, and potentially creating new voids in areas adjacent to producing formations.

To alleviate these problems, alternate path devices have been proposed that provide better distribution of the gravel throughout the completed interval. These systems typically provide an alternate path, such as through a conduit element, which extends along the length of the sand screens. If a bridge forms in the annulus area, the slurry can flow through the conduit element and into the annulus area below the bridge, thus enabling the filling of the annulus area below the bridge with gravel. To gravel pack a productive interval of substantial length, multiple sections of sand screens need to be is joined to provide the necessary length. The conduit elements also need to be joined to provide alternate path coverage over the entire productive interval. After the sand screen sections have been joined, jumper tubes can be used to connect the lengths of conduit that are located adjacent the sand screens. Having to make two separate connections, the sand screens and the conduits, is time consuming and results in increased rig time and cost.

There is a need for improved tools and methods to connect sand screens and their adjacent conduit elements.

SUMMARY OF THE INVENTION

One embodiment of the present invention is a tubular housing. The tubular housing comprises a housing wall defining a longitudinal bore providing a first fluid communication path therethrough. The housing wall further defining a longitudinal passageway providing a second fluid communication path therethrough. First and second ends provide for connecting a first sand screen assembly and a second sand screen assembly to the tubular housing.

The first fluid communication path is capable of communicating fluid flow from the first sand screen assembly to the second sand screen assembly. The second fluid communication path is capable of communicating fluid flow from a first alternate path element to a second alternate path. The longitudinal bore can be located eccentric with respect to the housing.

The tubular housing can comprise a first segment and a second segment releasably engaged. The first and second segments can be releasably engaged by threaded connectors, the threaded connectors capable of comprising timed threads capable of aligning the first and second segments. The first ends are capable of being attached to the sand screen assembly by welding. The first and second ends can be hingedly connected. The tubular housing can further comprise a sealing element that provides a seal for the first and second communication paths. Another embodiment of the invention is a wellbore completion system comprising a plurality of sand screen assemblies, the sand screen assemblies comprising screen members and alternate path members. The tool comprises least one connector having a wall defining an eccentric longitudinal bore, and a longitudinal passageway. The connector is provided for connecting the plurality of sand screen assemblies in fluid communication. The longitudinal bore of the at least one connector provides fluid communication between the screen members of the connected sand screen assemblies, and the longitudinal passageway provides fluid communication between the alternate path members of the connected sand screen assemblies. The at least one connector connects adjacent sand screen assemblies with the single make-up of the at least one connector.

Yet another embodiment is a connector comprising a tubular housing having a first end, a second end, an outer diameter and a housing wall, the outer diameter and housing wall defining an eccentric longitudinal bore. A longitudinal passageway defined by the housing wall provided for fluid communication between the first end and second end of the housing therethrough the housing wall. At least one of the first and second ends can comprise couplings. The couplings are provided for connecting two sand screen assemblies, the sand screen assemblies comprising screen elements and alternate path elements, the longitudinal bore providing fluid communication between the screen elements and the longitudinal passageway providing fluid communication between the alternate path elements. The couplings can comprise threaded elements or clamping elements and can be capable of being welded to the sand screen assemblies. The threaded elements can comprise timed threads capable of aligning the sand screen assemblies. The couplings can also comprise sealing elements.

The tubular housing can comprise a first section and one or more other sections, the first section comprising the longitudinal passageway. The sections can be joined by hinge elements and the connector is adapted for moving between an open position and a closed position. When the connector is in its closed position it is capable of connecting two sand screen assemblies and providing fluid communication between sand screen elements of the sand screen assemblies, and it is capable of providing fluid communication between alternate path elements of the sand screen assemblies. The longitudinal bore provides fluid communication between the sand screen elements of the two sand screen assemblies and the longitudinal passageway provides fluid communication between the alternate path elements of the two sand screen assemblies.

Still another embodiment is a connector comprising a first segment and a second segment, each segment comprising a first and second end. The first and second segments each comprise a housing wall defining a longitudinal bore providing a first fluid communication path therethrough, the housing wall further defining a longitudinal passageway providing a second fluid communication path therethrough. The first and second segments each comprise a first end having timed thread elements, the timed thread elements are capable of aligning the longitudinal bores and longitudinal passageways of the first and second segments while releasably connecting the first and second segments of the connector. The first and second segments can each comprise a second end capable of connecting to a sand screen assembly containing an alternate path element. The first and second segments can be capable of releasably connecting two sand screen assemblies and their alternate path elements.

An alternate embodiment of the invention is a wellbore completion method. The method comprising: providing a plurality of sand screen assemblies, the sand screen assemblies comprising screen members and alternate path members; providing at least one connector having a wall, the at least one connector comprising a longitudinal bore, and a longitudinal passageway within the connector wall; and connecting the plurality of sand screen assemblies with the make-up of the at least one connector, thereby providing fluid communication between the screen members of joined sand screen assemblies and between alternate path members of joined sand screen assemblies. The method can further comprise inserting the connected sand screen assemblies into the wellbore and performing a gravel pack completion on the wellbore. The alternate path members can be used as a conduit for hydraulic, pneumatic, electrical or fiber optic transmissions.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
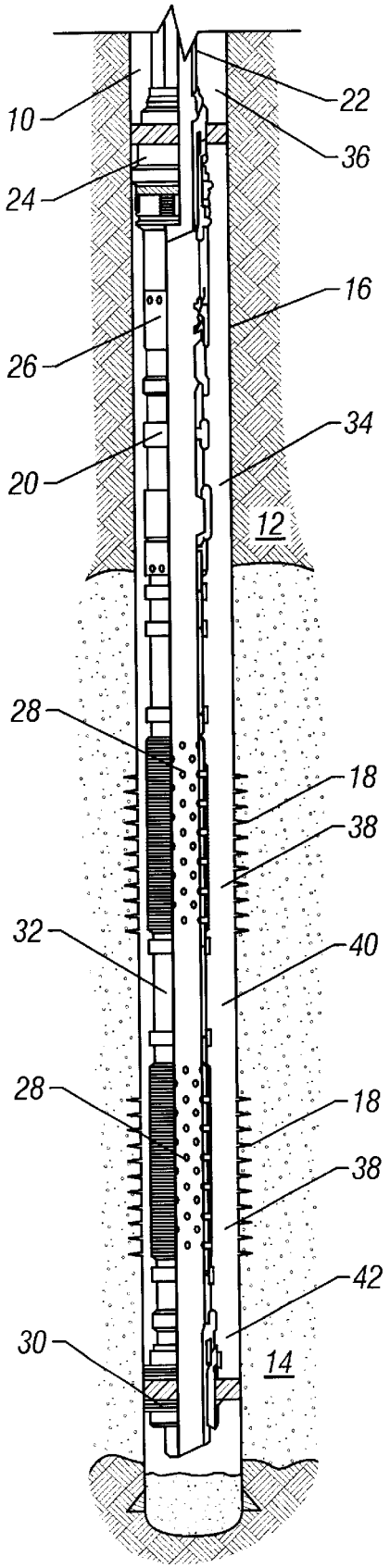
FIG. 1 (Prior Art)
FIG. 1 is a cross section of a wellbore showing a typical gravel pack completion apparatus. This illustration is of prior art.

Referring to the attached drawings, FIG. 1 illustrates a cross-sectional view of a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent to the productive formation 14, which is to be gravel packed.

The well tool 20 comprises a tubular member 22 attached to a production packer 24, a cross-over 26, one or more screen elements 28 and optionally a lower packer 30. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string.

In a gravel pack operation the packer elements 24, 30 are set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack.

An area that is prone to developing a void during a gravel pack operation is the annulus area 42 below the lowest screen element 28, sometimes referred to as the "sump". A gravel pack void in the sump 42 is particularly problematic in that it can allow the gravel from above to settle and fall into the voided sump 42. Production of fluids from the productive formation 14 can agitate or "fluff" the gravel pack and initiate the gravel to migrate and settle within the sump 42. This can lead to the creation of voids in the annulus areas 38 adjacent to the screen elements 28 and undermine the effectiveness of the entire well completion.

The area from the top perforation to the lowest perforation can be referred to as a completion zone. For a good gravel pack completion the entire completion zone should be tightly packed with gravel and contain no void areas.

As used herein, the term "screen" refers to wire wrapped screens, mechanical type screens and other filtering mechanisms typically employed with sand screens. Sand screens need to be have openings small enough to restrict gravel flow, often having gaps in the 60–120 mesh range, but other sizes may be used. The screen element 28 can be referred to as a sand screen. Screens of various types are produced by US Filter/Johnson Screen, among others, and are commonly known to those skilled in the art.

Figure 2:
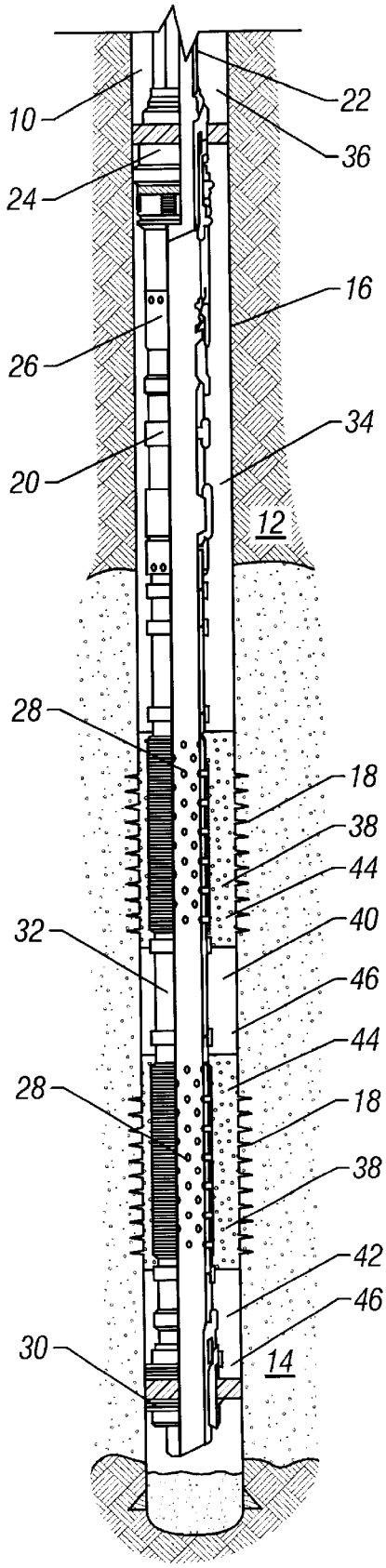
FIG. 2 (Prior Art)
FIG. 2 is a cross section of a wellbore showing a typical gravel pack completion that experienced gravel bridging. This illustration is of prior art.

FIG. 2 shows a cross-sectional view of a wellbore and illustrates how gravel bridging 44 can occur in the annulus area 38 adjacent to a screen element 28. This gravel bridging can result in a void area 46 within the gravel pack as shown in the annulus areas 40, 42.

Figure 3:
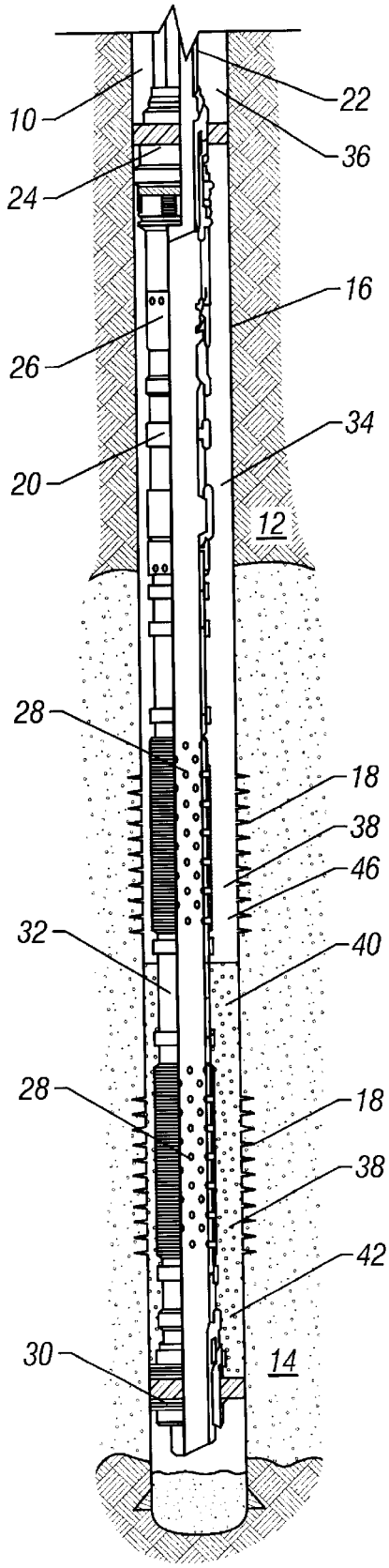
FIG. 3 (Prior Art)
FIG. 3 is a cross section of a wellbore showing a typical gravel pack completion that has experienced gravel bridging followed by gravel pack settling. This illustration is of prior art.

FIG. 3 is a cross-sectional view of a wellbore that illustrates one possible result of gravel settling within the gravel pack. As the gravel has settled within the wellbore 10, a void area 46 within the gravel pack has developed within the annulus area 38 adjacent to the upper screen element 28. This void area 46 now enables direct flow from the productive formation 14 to the screen element 28 and the tubular member 22, defeating the purpose of conducting the gravel pack completion.

Figure 4:
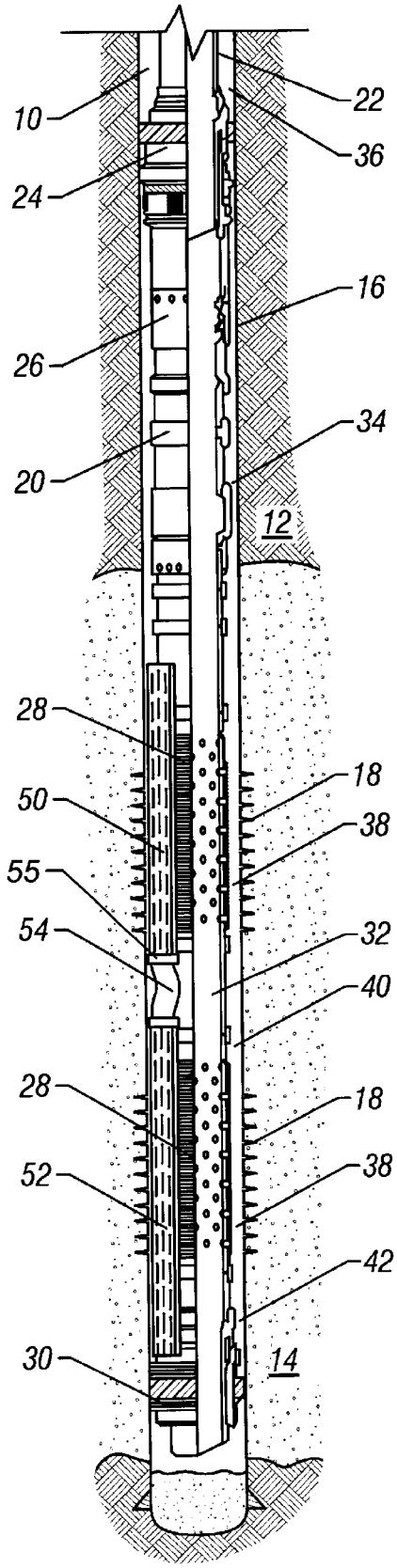
FIG. 4 (Prior Art)
FIG. 4 is a cross section of a wellbore showing a gravel pack completion apparatus utilizing an alternate path element. This illustration is of prior art.

Referring to FIG. 4, alternate flowpath elements 50, 52 can be attached to the screen elements 28 and placed within the annulus areas where additional flowpaths are desired, either for slurry dehydration, to enable the gravel slurry to bypass a gravel bridge or for use as a conduit element. The alternate flowpath elements 50, 52, sometimes referred to as conduits, are shown joined using a jumper tube 54 that provides a passageway connecting the interiors of the alternate flowpath elements 50, 52. The conduits 50, 52 can also be utilized to house control or transmission devices such as electrical wires or fiber optic cables. They can also be used as conduit passageways for hydraulic or pneumatic purposes.

When making up the well tool 20 as shown, the screen elements 28 are first joined, and then the conduits 50, 52 are joined using the jumper tube 54. This requires at least two separate connections to be made for each screen/conduit assembly, thus taking additional time and expense. The two screen elements 28 are first coupled together, typically with a standard threaded bow and pin type coupling, and then properly torqued so that the conduits 50, 52 are properly aligned. Next, the aligned conduits are connected together with a jumper tube 54. The jumper tube 54 can comprise couplers 55 on its ends that can be placed over the ends of the conduits 50, 52 and secured in place with a set screw (not shown) or other retaining device.

Seals (not shown), such as O-rings, can be used to provide a fluid tight seal between the conduits 50, 52 and the jumper tube 54. Attaching the jumper tube 54 can include the separate steps of: placement of the jumper tube 54 in relation to the conduits 50, 52; movement of the two couplers 55 to engagement with the respective conduit 50, 52, which may involve the hammering into place of the couplers 55; and then the engagement of the retaining devices on both couplers 55. Testing may also be required to ensure a secure seal and connection that will not be lost upon the insertion into the wellbore.

The combined length of the well tool 20 can comprise multiple sand screens 28 and other tools or instruments that can have a length of 1,000 feet or more. For an average joint having a length of twenty feet, fifty connections or more will be required to make up the entire well tool 20. It can be easily seen that the multiple manipulations required to connect this many jumper tubes will be time consuming and costly.

Figure 5:
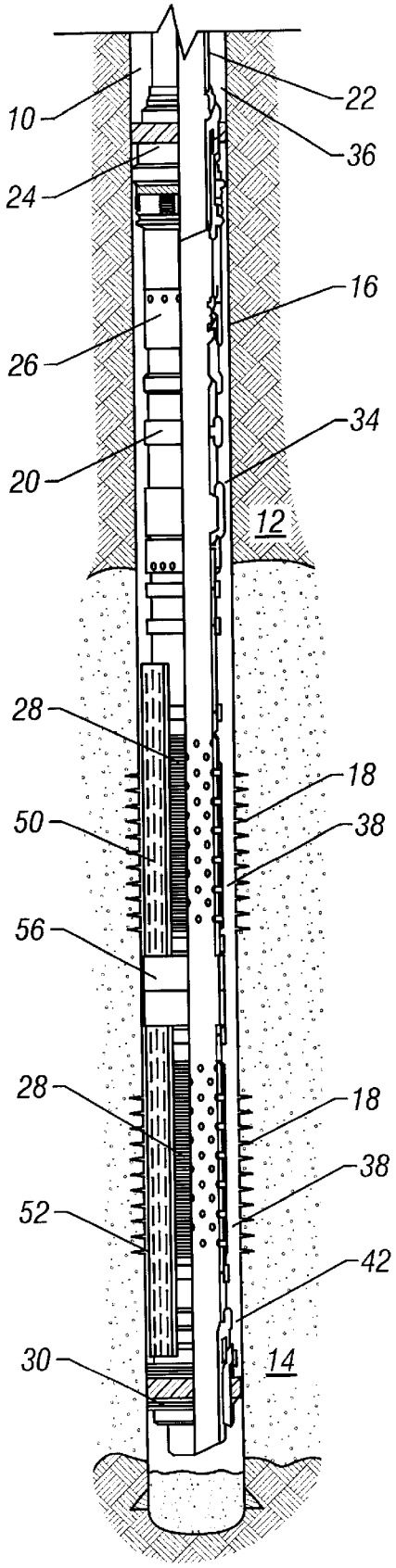
FIG. 5 is a cross section of a wellbore showing a gravel pack completion apparatus utilizing an embodiment of the present invention.

FIG. 5 shows a cross-sectional view of a wellbore having an embodiment of the present invention that includes a connector 56 that releasably joins the screen elements 28 and provides communication between the conduits 50, 52. One segment of the connector 56 is attached to the upper sand screen 28 and to the upper conduit 50, typically by welding. A second segment of the connector 56 is attached to the lower sand screen 28 and to the lower conduit 52. The connector 56 is made such that when the two segments of the connector are joined, they connect the sand screen elements 28 and also connect the upper conduit 50 to the lower conduit 52. The two segments of the connector 56 can be made up in a single motion, thus potentially saving time and expense over prior art methods.

Figure 6:
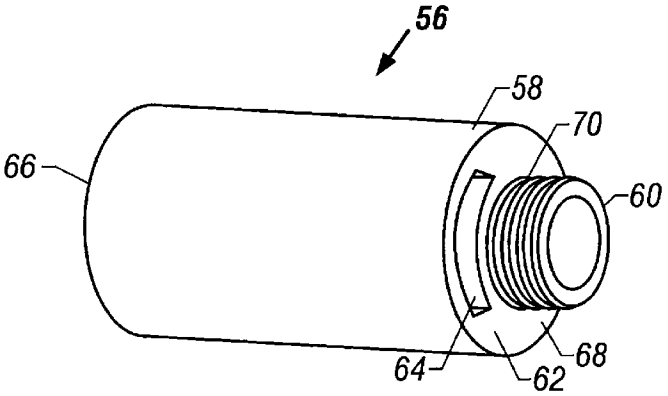
FIG. 6 is a side profile view of an embodiment of the present invention.

FIG. 6 is a side profile view of an embodiment of the invention comprising a housing 58 having a longitudinal bore 60 that defines a housing wall 62. Within the housing wall 62 is a longitudinal passageway 64 that provides fluid communication between a first end 66 and a second end 68 of the connector 56. The first end 66 is capable of attachment to a sand screen assembly, such as shown in FIG. 5, whereby the longitudinal bore 60 is connected to the sand screen elements 28 creating a first fluid communication path and the longitudinal passageway 64 is connected to the alternate path elements 50, 52 creating a second fluid communication path. The attachment to the sand screen assembly can be by welding the first end 66 of the connector 56 to the sand screen assembly, or by other means known to those skilled in the art.

Figure 8:
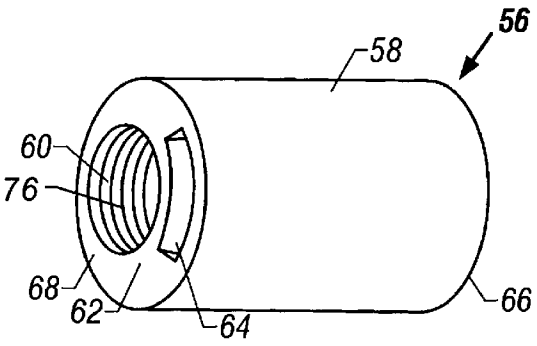
FIG. 8 is a side profile view of an alternate embodiment of the present invention.

The embodiment shown in FIG. 6 has a threaded male element 70 that can be mated to the end of a sand screen assembly. The embodiment of FIG. 6 can also comprise a first segment of a two-part connector such that the threaded male element 70 can be engaged with a mating threaded element of a second segment that is attached to a sand screen assembly, such as shown in FIG. 8. The releasable connections can include a sealing means, such as an elastomeric element located between the two segments that are being joined. Alternate means of releasably connecting the segments, other than the use of threaded elements, can also be used.

Figure 7:
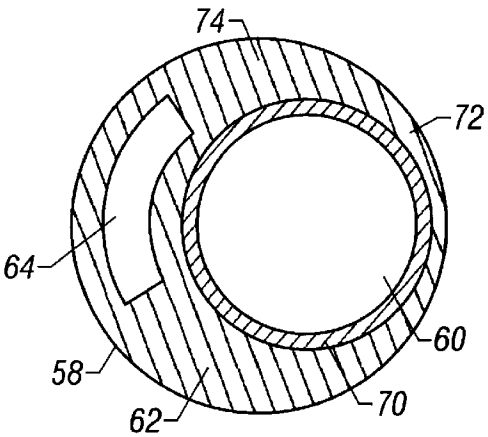
FIG. 7 is an end view of the embodiment shown in FIG. 6.

FIG. 7 is an end view of the second end 68 of the embodiment shown in FIG. 6. The housing 58 and longitudinal bore 60 define the wall 62. It can be seen that in this embodiment the longitudinal bore 60 is eccentrically located within the housing 58 outer diameter, thus creating a thin section 72 and a thick section 74 of the housing wall 62. The longitudinal passageway 64 is disposed within the thick section 74 of the wall 62. The relative locations of the offset longitudinal bore 60 and the longitudinal passageway 64 enable the joining of the sand screens 28 and the side-mounted conduits 50, 52 as shown in FIG. 5. The longitudinal bore 60 could be located concentric within the housing 58. More than one longitudinal passageway can be located within the wall 62, thereby providing a means of connecting sand screens comprising more than one conduit element.

FIG. 8 is a side profile view of an alternate embodiment of the invention comprising a housing 58 having a longitudinal bore 60 that defines the housing wall 62. Within the housing wall 62 is a longitudinal passageway 64 that provides fluid communication between a first end 66 and a second end 68 of the connector 56. The first end 66 is capable of attachment to a sand screen assembly, such as shown in FIG. 5, whereby the longitudinal bore 60 is connected to the sand screen elements 28 and the longitudinal passageway 64 is connected to the conduits 50, 52.

The embodiment shown in FIG. 8 has a threaded female element 76 that can be mated to the end of a sand screen assembly. The embodiment of FIG. 8 can also comprise a second segment of a two-part connector such that the threaded female element 76 can be engaged with a mating threaded male element 70 of a first segment that is attached to a sand screen assembly, such as shown in FIG. 6.

The threaded elements 70, 76 can comprise "timed threads" that are designed so that when the two threaded elements 70, 76 are properly connected, the longitudinal passageway 64 connecting the conduits 50, 52 will be in proper alignment. Typical threaded connections can vary in their alignment depending on the amount of torque imposed upon the connection during make-up and typically require external markings that need to be aligned by adjusting the amount of torque applied. Timed threads are designed such that the treaded elements are in correct alignment whenever the connection is in the proper torque range of connection make-up, regardless of the actual torque level imposed. Various types of timed threads are known within the industry, such as those manufactured by Hunting Oilfield Services, Inc. of Houston, Tex. A timed thread connector can increase both the speed in which the connection is made and the reliability of alignment of the connection over standard threaded connections. Embodiments utilizing timed threads can include both eccentrically and concentrically located longitudinal bores and can comprise one or more longitudinal passageway.

Figure 9:
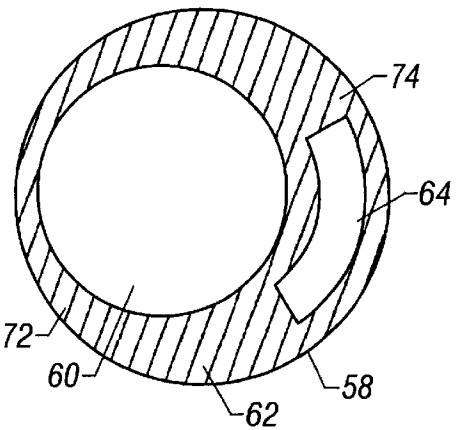
FIG. 9 is an end view of the embodiment of the present invention shown in FIG. 8.

FIG. 9 is an end view of the second end 68 of the embodiment shown in FIG. 8. The housing 58 and longitudinal bore 60 define the wall 62. It can be seen that the longitudinal bore 60 in this particular embodiment is eccentrically located within the housing 58, thus creating a thin section 72 and a thick section 74 of the housing wall 62. The longitudinal passageway 64 is disposed within the thick section 74 of the wall 62.

Figure 10:
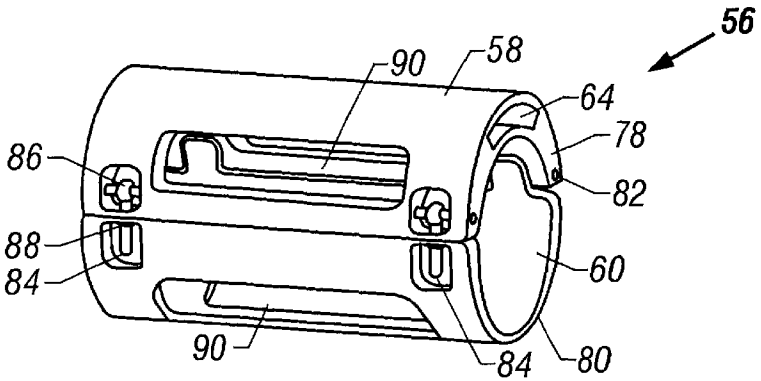
FIG. 10 is a side profile view of an embodiment of the present invention.

FIG. 10 is a side profile view of an alternate embodiment of the invention wherein the connector 56 comprises a clamping configuration. The housing 58 comprises a first section 78 and a second section 80 that are joined by a hinge mechanism 82 and retaining elements 84. The first section 78 has a generally thicker wall 62 than the second section 80. The longitudinal bore 60 is created by the joining of the two sections 78, 80 and is eccentric in respect to the housing 58 due to the thickness differences of the two sections 78, 80. The longitudinal passageway 64 is disposed within the thicker first section 78. The two sections 78, 80 can move in relation to each other by rotating on the hinge mechanism 82, thereby enabling the connector 56 to move between an open and closed configuration. FIG. 10 shows the embodiment in its closed configuration, being held in the closed configuration by the retaining elements 84. The retaining elements 84 shown comprise a pin 86 and nut 88 assembly, but other retaining methods known to those of ordinary skill in the art can also be used.

The connector 56 is used to connect the sand screen assemblies together by first disengaging the retaining elements 84 and moving the two sections 78, 80 about the hinge mechanism 82 until the connector 56 is in its open configuration. The longitudinal passageway 64 is aligned with the two conduits to be joined, for example by inserting the conduits into the longitudinal passageway. The sections are then rotated about the hinge mechanism 82 to place the connector 56 in its closed configuration, encircling the ends of the sand screen assemblies that it is joining. Windows 90 located within the housing 58 can be used to ensure correct alignment and placement of the sand screen assemblies within the connector 56 while closing the connector 56. Sealing elements can be used within the longitudinal passageway 64 to provide a seal with respect to the conduits that are being joined. Sealing elements can also be used within the longitudinal bore 60 to provide a seal to the sand screens being joined within the connector 56. The sealing elements can comprise elastomeric substances such as conventional O-ring sealing elements. As with the threaded embodiments of the invention, hinged embodiments can be used for both eccentrically and concentrically located longitudinal bores and can comprise more than one longitudinal passageway within its wall.

Figure 11:
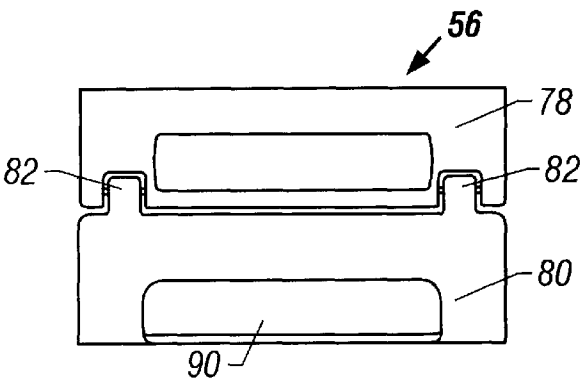
FIG. 11 is a side view of the embodiment shown in FIG. 10.

FIG. 11 shows a side view of the embodiment of the connector 56 shown in FIG. 10 illustrating the hinge mechanism 82 used to join the first section 78 to the second section 80.

Figure 12:
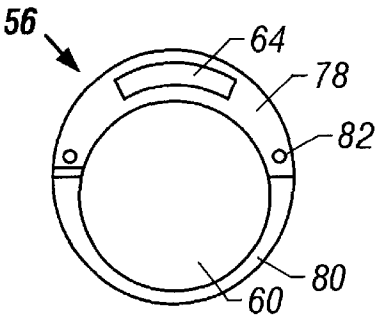
FIG. 12 is an end view of the embodiment shown in FIG. 10.

FIG. 12 is an end view of the embodiment shown in FIG. 10. The first section 78 is shown connected to the second section 80 by the hinge mechanism 82 and is shown in the closed configuration. It can be seen that the longitudinal bore 60 is eccentrically located within the housing 58 outer diameter when the connector 56 is in the closed configuration. The longitudinal passageway 64 is disposed within the first section 78. The relative locations of the offset longitudinal bore 60 and the longitudinal passageway 64 enable the joining of the sand screens 28 and the side-mounted conduits 50, 52 as shown in FIG. 5.

Figure 13:
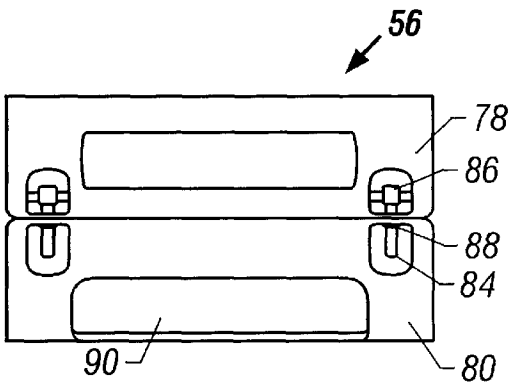
FIG. 13 is a side view of the embodiment shown in FIG. 10.

FIG. 13 shows a side view of the embodiment of FIG. 10 illustrating the retaining elements 84 used to attach the first section 78 to the second section 80 when in the closed configuration. The retaining elements 84 shown comprise a pin 86 and nut 88 assembly, but other attaching means can also be used.

Figure 14:
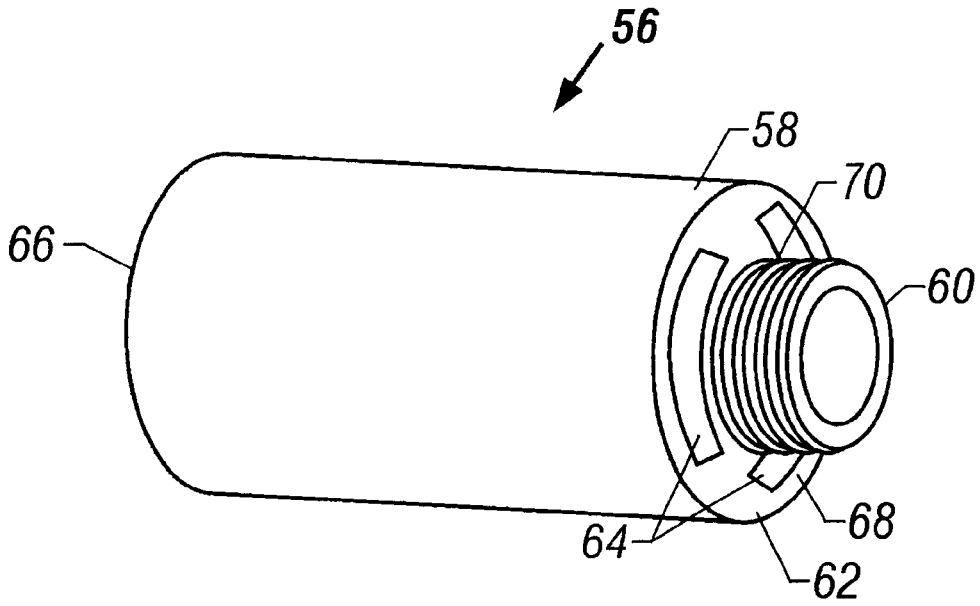
FIG. 14 is a side profile view of an embodiment of the present invention.

FIG. 14 is a side profile view of an embodiment of the invention comprising a housing 58 having a longitudinal bore 60 that defines a housing wall 62. Within the housing wall 62 is a plurality of longitudinal passageways 64 that provide fluid communication between a first end 66 and a second end 68 of the connector 56. The first end 66 is capable of attachment to a sand screen assembly whereby the longitudinal bore 60 is connected to the screen element creating a first fluid communication path and the longitudinal passageways 64 are connected to the conduit elements creating a plurality of secondary pathways. The attachment to the sand screen assembly can be by welding the first end 66 of the connector 56 to the sand screen assembly, or by other means known to those skilled in the art.

The embodiment shown in FIG. 14 has a threaded male element 70 and can comprise a first segment of a two-part connector such that the threaded male element 70 can be engaged with a mating threaded element of a second segment that is attached to a second sand screen assembly. The threaded male element 70 and its mating element can comprise a timed thread pattern that will ensure proper alignment of the longitudinal passageways 64 when the two-part connector is made up. The releasable connections can include a sealing means, such as an elastomeric element located between the two segments that are being joined.

Figure 15:
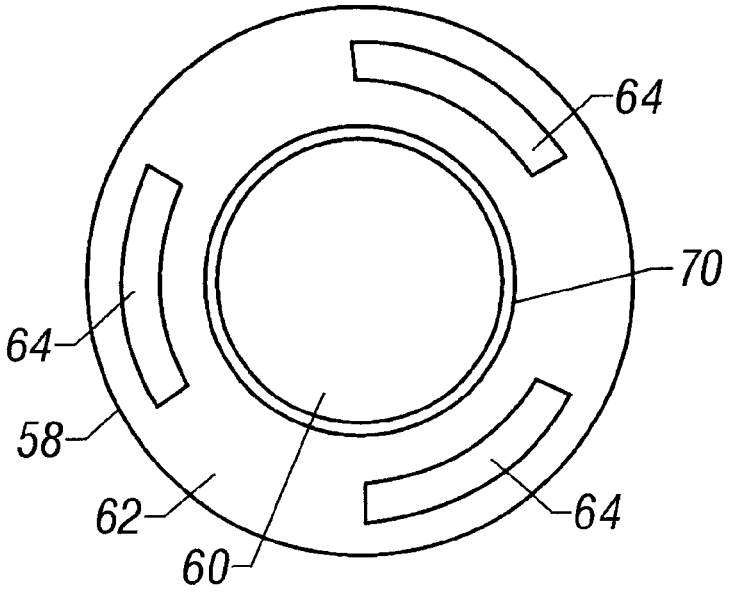
FIG. 15 is an end view of the embodiment shown in FIG. 14.

FIG. 15 is an end view of the second end 68 of the embodiment shown in FIG. 14. The housing 58 and longitudinal bore 60 define the wall 62. It can be seen that in this embodiment the longitudinal bore 60 is concentrically located within the housing 58 and the longitudinal passageways 64 are disposed within the wall 62.

The present invention provides a means of connecting sand screen assemblies that comprise alternate flowpath elements, such as externally mounted conduits. The embodiments of the present invention enable the connection of both the sand screens and the conduits in a single action, that of making up the connector of the invention. A single action connection has the potential of saving time and expense over previous apparatus and methods that required two actions to be performed, those being the separate joining of the sand screens and the conduits.

Some of the discussion and illustrations within this application may refer to a vertical wellbore that has casing cemented in place and comprises casing perforations to enable communication between the wellbore and the productive formation. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A tubular housing, comprising:

a housing wall defining a longitudinal bore providing a first fluid communication path therethrough, the housing wall further defining a longitudinal passageway providing a second fluid communication path therethrough; and first and second ends provided for connecting a first sand screen assembly and a second sand screen assembly to the tubular housing, wherein the second fluid communication path is capable of communicating fluid flow from a first alternate path element to a second alternate path element; and wherein the tubular housing comprises a first segment and a second segment releasably engaged.

2. The tubular housing of claim 1, wherein the first and second segments are releasably engaged by threaded connectors.

3. The tubular housing of claim 2, wherein the threaded connectors comprise timed threads capable of aligning the first and second segments.

4. A tubular housing, comprising:

a housing wall defining a longitudinal bore providing a first fluid communication path therethrough, the housing wall further defining a longitudinal passageway providing a second fluid communication path therethrough; and first and second ends provided for connecting a first sand screen assembly and a second sand screen assembly to the tubular housing, wherein the tubular housing comprises a first segment and a second segment releasably engaged; and wherein the first and a second segments are hingedly connected.

5. A tubular housing, comprising:

a housing wall defining a longitudinal bore providing a first fluid communication path therethrough, the housing wall further defining a longitudinal passageway providing a second fluid communication path therethrough; and first and second ends provided for connecting a first sand screen assembly and a second sand screen assembly to the tubular housing, wherein the second fluid communication path is capable of communicating fluid flow from a first alternate path element to a second alternate path element; and wherein the tubular housing further comprises a sealing element that provides a seal for the first and second communication paths.

6. A wellbore completion system, comprising:

a plurality of sand screen assemblies, the sand screen assemblies comprising screen members and alternate path members;

at least one connector having a wall defining a longitudinal bore and a longitudinal passageway therethrough, wherein the at least one connector is provided for connecting the plurality of sand screen assemblies in fluid communication; and wherein the longitudinal passageway of the at least one connector provides fluid communication between the alternate path members of the connected sand screen assemblies.

7. The wellbore completion system of claim 6, wherein the longitudinal bore of the at least one connector provides fluid communication between the screen members of the connected sand screen assemblies.

8. The wellbore completion system of claim 6, wherein the at least one connector connects adjacent sand screen assemblies with the single make-up of the at least one connector.

9. The wellbore completion system of claim 6, wherein the longitudinal bore is eccentric with respect to the at least one connector.

10. A connector comprising:

a tubular housing having a first end, a second end, an outer diameter and a housing wall, the outer diameter and housing wall defining a longitudinal bore; and a longitudinal passageway defined by the housing wall provided for fluid communication between the first end and second end of the housing therethrough the housing wall, wherein at least one of the first and the second ends comprise couplings; and wherein the couplings are provided for connecting two sand screen assemblies, the sand screen assemblies comprising screen elements and alternate path elements, the longitudinal bore providing fluid communication between the screen elements and the longitudinal passageway providing fluid communication between the alternate path elements.

11. The connector of claim 10, wherein at least one of the couplings comprise threaded elements.

12. The connector of claim 11, wherein the threaded elements comprise timed threads capable of aligning the sand screen assemblies.

13. The connector of claim 10, wherein at least one of the couplings are capable of being welded to the sand screen assemblies.

14. The connector of claim 10, wherein the longitudinal bore is located eccentric to the tubular housing.

15. A connector comprising:

a tubular housing having a first end, a second end, an outer diameter and a housing wall, the outer diameter and housing wall defining a longitudinal bore; and a longitudinal passageway defined by the housing wall provided for fluid communication between the first end and second end of the housing therethrough the housing wall, wherein at least one of the first and the second ends comprise couplings; and wherein at least one of the couplings comprise clamping elements.

16. A connector comprising:

a tubular housing having a first end, a second end, an outer diameter and a housing wall, the outer diameter and housing wall defining a longitudinal bore; and a longitudinal passageway defined by the housing wall provided for fluid communication between the first end and second end of the housing therethrough the housing wall, wherein at least one of the first and the second ends comprise couplings; and wherein at least one of the couplings comprise sealing elements.

17. A connector comprising:

a tubular housing having a first end, a second end, an outer diameter and a housing wall, the outer diameter and housing wall defining a longitudinal bore; and a longitudinal passageway defined by the housing wall provided for fluid communication between the first end and second end of the housing therethrough the housing wall, wherein the tubular housing comprises a first section and one or more other sections, the first section comprising the longitudinal passageway.

18. A connector comprising:

a tubular housing having a first end, a second end, an outer diameter and a housing wall, the outer diameter and housing wall defining a longitudinal bore; and a longitudinal passageway defined by the housing wall provided for fluid communication between the first end and second end of the housing therethrough the housing wall, wherein the tubular housing comprises a first section and one or more other sections, the first section comprising the longitudinal passageway; and wherein the sections are joined by hinge elements and the connector is adapted for moving between an open position and a closed position.

19. A connector, comprising:

a first segment and a second segment, each segment comprising a first and second end;

the first and second segments each comprising a housing wall defining a longitudinal bore providing a first fluid communication path therethrough, the housing wall further defining a longitudinal passageway providing a second fluid communication path therethrough; and the first and second segments each comprising a first end having timed thread elements, the timed thread elements capable of aligning the longitudinal bores and longitudinal passageways of the first and second segments while releasably connecting the first and second segments of the connector.

20. The connector of claim 19, wherein the first and second segments each comprise a second end capable of connecting to a sand screen assembly containing an alternate path element.

21. The connector of claim 19, wherein the first and second segments are capable of releasably connecting two sand screen assemblies and their alternate path elements.

22. A wellbore completion method, comprising:

providing a plurality of sand screen assemblies, the sand screen assemblies comprising screen members and alternate path members;

providing at least one connector having a wall, the at least one connector comprising a longitudinal bore and a longitudinal passageway within the connector wall; and connecting the plurality of sand screen assemblies with the make-up of the at least one connector, thereby providing fluid communication between the screen members of joined sand screen assemblies and between alternate path members of joined sand screen assemblies via the longitudinal passageway.

23. The method of claim 22, further comprising:

inserting the connected sand screen assemblies into the wellbore; and performing a gravel pack completion on the wellbore.

24. The method of claim 22, further comprising:

using the alternate path members as a transmission conduit.

* * * * *